US010451254B2

(12) United States Patent
Didone' et al.

(10) Patent No.: US 10,451,254 B2
(45) Date of Patent: Oct. 22, 2019

(54) LIGHTING DEVICE AND CORRESPONDING FIXING SYSTEM

(71) Applicant: OSRAM GmbH, Munich (DE)

(72) Inventors: Roberto Didone', Rosà (IT); Alberto Zanotto, Padua (IT); Simon Bobbo, Mirano (IT); Luca Volpato, Preganziol (IT)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 15/708,218

(22) Filed: Sep. 19, 2017

(65) Prior Publication Data

US 2018/0080637 A1 Mar. 22, 2018

(30) Foreign Application Priority Data

Sep. 20, 2016 (IT) ..... 102016000094481

(51) Int. Cl.
*F21V 17/10* (2006.01)
*F21S 4/20* (2016.01)
(Continued)

(52) U.S. Cl.
CPC ..... *F21V 17/104* (2013.01); *F21S 2/005* (2013.01); *F21S 4/20* (2016.01); *F21S 4/28* (2016.01); *F21S 8/033* (2013.01); *F21V 3/02* (2013.01); *F21V 15/01* (2013.01); *F21V 21/005* (2013.01); *F21V 21/025* (2013.01); *F21V 33/0012* (2013.01); *F21Y 2103/10* (2016.08); *F21Y 2115/00* (2016.08); *F21Y 2115/10* (2016.08)

(58) Field of Classification Search
CPC ..... F21S 2/005; F21S 4/20; F21S 4/28; F21S 8/033; F21V 15/01; F21V 17/104; F21V 21/005; F21V 21/025; F21V 3/02; F21Y 2103/10; F21Y 2115/10
See application file for complete search history.

(56) References Cited

U.S. PATENT DOCUMENTS 7,766,505 B2 * 8/2010 Tseng ..... F21S 2/005 362/217.17
7,887,216 B2 * 2/2011 Patrick ..... F21S 8/04 362/218
(Continued)

FOREIGN PATENT DOCUMENTS

DE 202014101986 U1 9/2015
EP 2083212 A1 7/2009
(Continued)

OTHER PUBLICATIONS

Italian Search Report based on application No. 102016000094481 (7 pages) dated May 12, 2017 (Reference Purpose Only).
(Continued)

*Primary Examiner* — Peggy A Neils
(74) *Attorney, Agent, or Firm* — Viering Jentschura & Partner MBB

(57) ABSTRACT

A lighting device may include an elongated body having at least one light emission surface. The body has at least one longitudinal groove extending along the elongated body. The groove has a tapered cross-section with a restricted mouth portion for receiving and retaining in the groove a complementary coupling element having a restricted stem portion and an enlarged head portion.

13 Claims, 5 Drawing Sheets

(51) Int. Cl.

| | |
|---|---|
| ***F21V 3/02*** | (2006.01) |
| ***F21V 15/01*** | (2006.01) |
| ***F21V 21/005*** | (2006.01) |
| ***F21S 2/00*** | (2016.01) |
| ***F21S 8/00*** | (2006.01) |
| ***F21S 4/28*** | (2016.01) |
| ***F21Y 115/00*** | (2016.01) |
| ***F21V 33/00*** | (2006.01) |
| ***F21V 21/02*** | (2006.01) |
| ***F21Y 103/10*** | (2016.01) |
| ***F21Y 115/10*** | (2016.01) |

(56) References Cited

U.S. PATENT DOCUMENTS

| | | | | |
|---|---|---|---|---|
| 8,066,403 | B2 * | 11/2011 | Sanfilippo | F21S 2/005 362/219 |
| 9,423,116 | B2 * | 8/2016 | Sieberth | F21V 23/06 |
| 9,933,123 | B2 | 4/2018 | Ladstaetter | |
| 2007/0058377 | A1 | 3/2007 | Zampini, II et al. | |
| 2009/0168422 | A1 * | 7/2009 | Chiu | F21S 2/005 362/249.03 |
| 2010/0103657 | A1 | 4/2010 | Teng et al. | |
| 2015/0260389 | A1 * | 9/2015 | Caron | F21V 29/74 362/218 |
| 2017/0122509 | A1 | 5/2017 | Ladstaetter | |

FOREIGN PATENT DOCUMENTS

| | | | |
|---|---|---|---|
| EP | 2267356 | A1 | 12/2010 |
| WO | 2010143147 | A1 | 12/2010 |
| WO | 2012148313 | A1 | 11/2012 |
| WO | 2013160834 | A2 | 10/2013 |

OTHER PUBLICATIONS

European Search Report based on application No. 17190624.1 (9 pages) dated Oct. 27, 2017 (for reference purpose only).

Office Action issued for corresponding European patent application No. 17190624.1, dated Dec. 13, 2018, 5 pages (reference purpose only).

* cited by examiner

FIG. 4
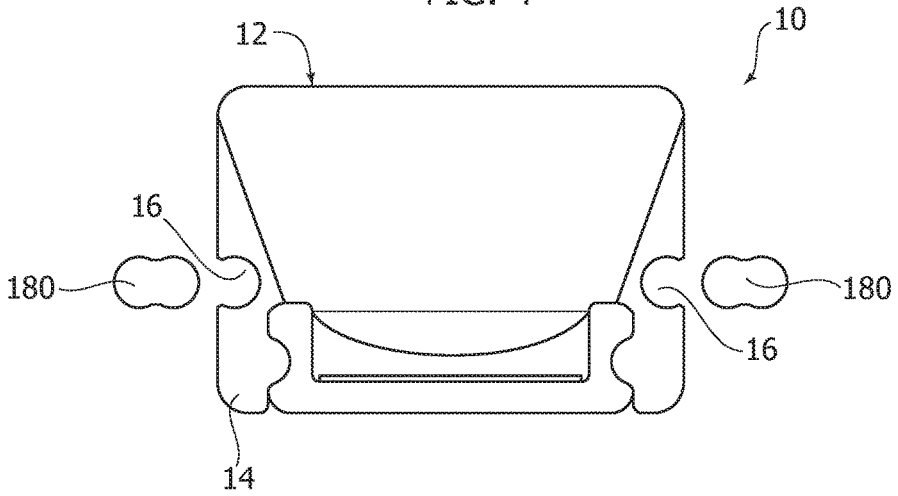
FIG. 5
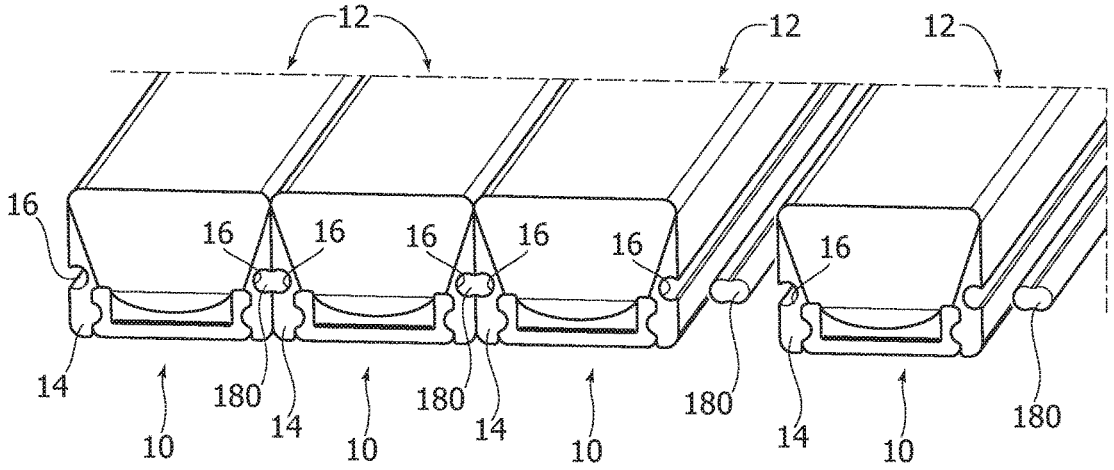
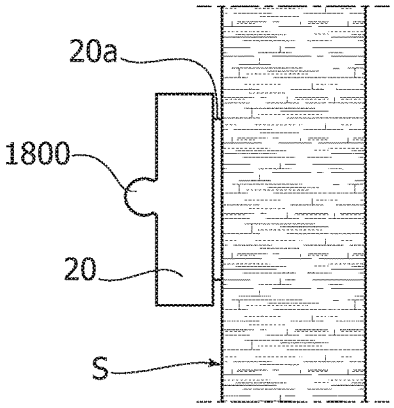
FIG. 6

LIGHTING DEVICE AND CORRESPONDING FIXING SYSTEM

CROSS-REFERENCE TO RELATED APPLICATION

This application claims priority to Italian Patent Application Serial No. 102016000094481, which was filed Sep. 20, 2016, and is incorporated herein by reference in its entirety.

TECHNICAL FIELD

Various embodiments generally relate to lighting devices.

One or more embodiments may refer to lighting devices employing electrically-powered light radiation sources, e.g. solid-state light radiation sources, such as LED sources.

BACKGROUND

In the use of linear lighting devices, e.g. elongated (ribbon-shaped and/or flexible), so called "flex" lighting devices, the problem may arise of mechanically connecting a plurality of devices, which may be arranged in parallel, and/or of fixing lighting devices onto support structures. These needs may be felt e.g. for modules which are protected (e.g. which have an IP protection grade) against the penetration of external agents.

In order to implement the connection/fixation of such modules, the use of mechanical support elements has been proposed such as bridge-like elements or clips, as well as the use of specific mechanical fixtures such as profiles (e.g. aluminium profiles) having a comb-like cross-section profile, and including therefore a series of grooves for mounting the devices.

These solutions may have various drawbacks.

For example, they may require the presence of a gap between adjoining modules, and this may originate a lack of uniformity in the distribution of the light radiation emission (e.g. the appearance of stripes, given by the presence of dark lines between adjoining modules). The same problem may arise with fixing bridges or clips, if the latter cover the lighting device.

Another proposed solution envisages adhesive fixation, e.g. by means of adhesive tapes: this solution, however, may originate difficulties in achieving a parallel arrangement of adjoining modules.

Generally speaking, these known solutions may basically exhibit three types of problems:

- additional costs (related e.g. to the need of using additional materials or process steps),
- negative effects on the appearance of the lighting device (as described in the foregoing),
- difficulty in achieving a perfectly uniform light radiation emission area in the final application.

SUMMARY

One or more embodiments aim at overcoming the previously outlined drawbacks.

One or more embodiments relate to a lighting device.

One or more embodiments may also concern a corresponding fixing method.

According to one or more embodiments, a lighting device (e.g. a LED module having an elongated body) may be provided with one or more lateral grooves, configured so as to enable the mechanical connection of a plurality of modules without necessarily resorting to additional fixing elements such as bridges, clips, adhesive tapes, various metal or polymer profiles, which may impair the appearance of the lighting device and/or the uniformity of light emission.

In one or more embodiments, various implementations of such lateral grooves may be envisaged. For example, one or more embodiments may employ an "asymmetric" solution, which does not require additional elements for coupling a plurality of modules.

On the other hand, one or more embodiments may envisage a "symmetric" arrangement, which may be achieved by resorting to an intermediate profiled element.

One or more embodiments may also simplify the mechanical fixation of modules onto various support structures.

One or more embodiments may be used to achieve a good mechanical coupling between LED modules, especially protected modules, also as regards the possible connection to electrical elements.

In the modules adapted to be cut to length according to the application and usage needs, one or more embodiments are moreover adapted to be used in combination with end caps, as described in a Patent Application for Industrial Invention filed by the same Applicants on the same date.

One or more embodiments lead to the achievement of one or more of the following advantages:

- A well paired mechanical fixation between two or more lighting modules (e.g. flexible protected modules) without the need of additional mechanical supports, such as clips or profiled elements, which may originate dark areas also in applications providing rather wide stripes or even area lighting, e.g. according to a concept of modularity;
- The choice is possible between an asymmetric design, enabling the mechanical connection of several modules without the use of additional accessories, and a symmetric design, which may be used in combination with a wire-like element having a "puzzle-shaped" cross-section profile;
- The mechanical fixation for the application of lighting modules onto walls or panels/surfaces of various kinds may be achieved without using mechanical tools for installing and removing modules; moreover, the risk is minimized of undesirable damages of the modules during installation/removal, with the consequent possibility of re-using or differently positioning such modules for new applications, also within one and the same installation;
- A firm mechanical connection between lighting modules and various connectors (e.g. IP connectors) may be obtained by providing the connector with fixation elements, which enable e.g. the insertion into the lighting module, optionally with a mechanical pressing action which takes advantage of the softness or resilience of the material (e.g. silicone) which may be used to implement the casing of the lighting module;
- The risks of mechanical damages during the application of the connectors are further reduced, e.g. thanks to movable parts which may be mechanically clamped in a locking position after positioning the connector;
- The grooves provided on the walls of the lighting devices are compatible with standard fixation methods which are already in use, e.g. bridges or plastic or metal clips and/or channel-shaped profiles.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
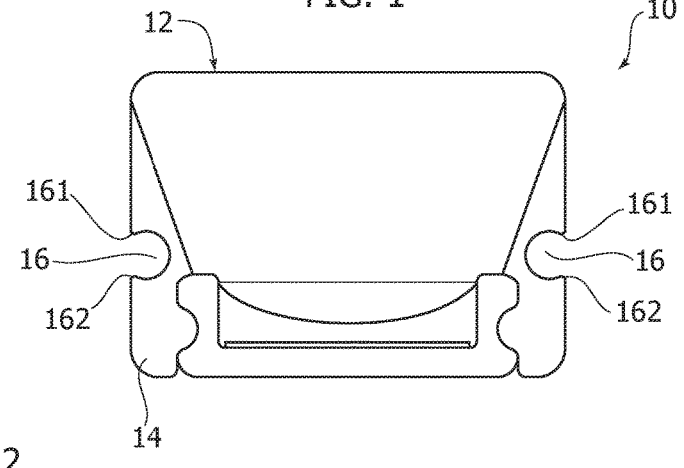
FIGS. 1 and 2 exemplify possible embodiments.

In the following description, various specific details are given to provide a thorough understanding of various exemplary embodiments. The embodiments may be practiced without one or several specific details, or with other methods, components, materials, etc. In other instances, well-known structures, materials or operations are not shown or described in detail to avoid obscuring various aspects of the embodiments.

Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment. Furthermore, particular features, structures, or characteristics may be combined in any suitable manner in one or more embodiments.

The headings provided herein are for convenience only, and therefore do not interpret the extent of protection or scope of the embodiments.

In the figures, reference 10 denotes a lighting device including an elongated (e.g. ribbon-shaped and/or flexible) body, having at least one, e.g. front, light emission surface 12.

In one or more embodiments, the body of device 10 may include a casing 14 (which may be e.g. at least approximately channel-shaped) which hosts a light radiation generating structure. In one or more embodiments, said structure may include a ribbon-shaped substrate such as a Printed Circuit Board (PCB) whereon there are distributed electrically-powered light radiation sources, (for example solid-state light radiation sources, such as LED sources), the radiation generated by said sources being emitted through surface 12.

In one or more embodiments, casing 14 may be made of a material at least partly light-impermeable such as a silicone material, the portion of the device 10 corresponding to the light radiation emission surface 12 being coupled to the casing 14 so as to impart to device 10 the features of a device protected (e.g. having an IP protection grade) against the penetration of external agents such as water, condensate, various particles etc.

Lighting devices (modules) 10 of this kind are known in the art, which makes it unnecessary to provide a more detailed description herein.

Said devices or modules (shown in Figures such as FIGS. 1, 2, 4 and 12 in an ideal cross-section) may be considered as elements of indefinite length, which are adapted to be optionally cut to length according to the application and usage needs; as mentioned in the foregoing, one or more embodiments as exemplified herein may be used in combination with end caps (adapted to preserve the protection features at the exposed end(s), which may have been obtained via a cutting operation).

In one or more embodiments, the casing 14 of the device 10, e.g. at a lateral position of the same, may be provided with at least one groove 16, extending lengthwise along device 10.

In one or more embodiments, groove 16 may have a tapered cross-section with a restricted mouth portion, so that groove 16 may retain ("capture") a complementary coupling element therein, e.g. according to the solutions described in the following.

In one or more embodiments, said tapered cross-section may extend along an at least approximately circular path (see for example the two grooves 16 shown in FIG. 1), said restricted mouth portion being delimited by two edges 161, 162 (shown as such only in FIG. 1) located at the ends of a chord of said circular path along which the cross-section of groove 16 extends.

Said cross-section may be defined by taking into account the mechanical features of the material of body 10 (e.g. a silicone material). For example, it is possible to take into account the residual roughness deriving from an extrusion forming process of casing 14: said residual roughness may originate a friction between groove 15 and a complementary element, adapted to be placed therein (and adapted to be implemented by means of the same process), so as to simplify the achievement of a firm retention force.

One or more embodiments may envisage the presence of a plurality of grooves 16, e.g. located with a specular symmetry with respect to a lengthwise median plane of device 10, as exemplified in FIG. 1.

Figure 2:
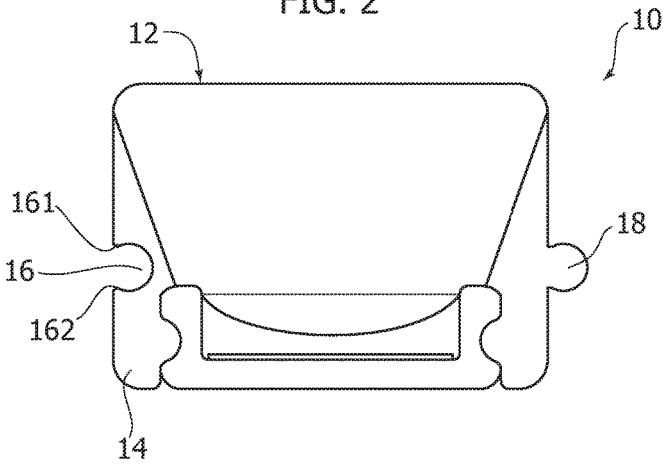

One or more embodiments may envisage the presence, on a side of casing 14, of a groove 16 accompanied by the possible presence, e.g. on the opposed side of casing 14, of a rib 18 having a cross-section profile complementary to the profile of groove 16, i.e. having a restricted stem portion and an enlarged head portion; this embodiment may be defined as asymmetric, as exemplified in FIG. 2.

Both the symmetric and the asymmetric designs are compatible with the implementation of device 10 as a protected device (e.g. having an IP protection grade).

Figure 3:
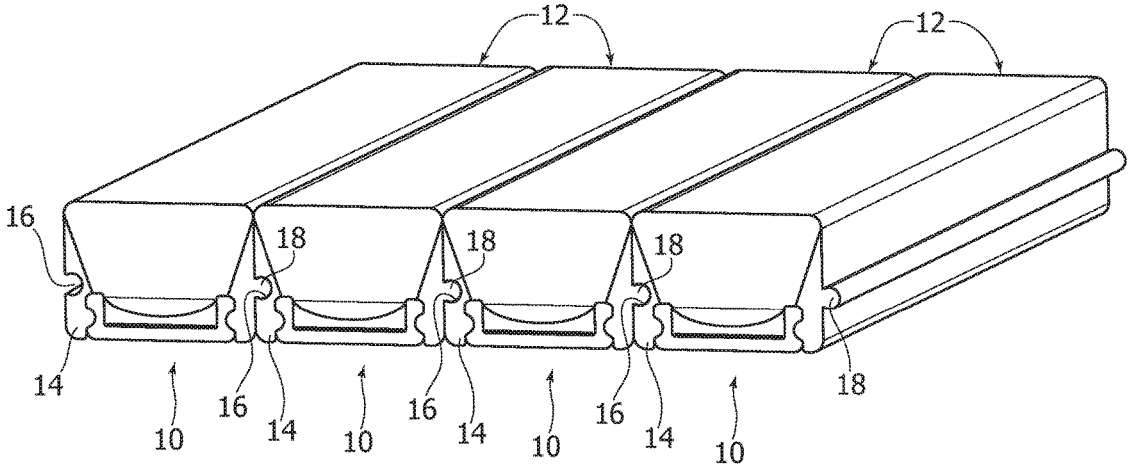
FIG. 3 exemplifies possible usages of the embodiments according to FIG. 2, FIGS. 4 and 5 exemplify possible usages of the embodiments according to FIG. 1, FIGS. 6 to 8 exemplify possible applications of embodiments, FIG. 9 exemplifies possible embodiments, and FIGS. 10 to 15 exemplify various usages of embodiments.

As shown, by way of example only, in FIG. 3, the possible choice of an asymmetric design enables implementing a modular system according to the criteria schematically shown in FIG. 3, based on a male-female connection, i.e. with the rib 18, provided on one side (e.g. on the right side in FIG. 2) of module 10, engaging the groove 16 provided on the opposite side (the left side in FIG. 2) of an adjoining module.

Said coupling of a rib 18 with a groove 16 may be obtained, for example, by sliding in the lengthwise direction two adjoining modules 10, which are coupled after inserting the rib 18 of a module into a groove 16 in the adjoining module, or by taking advantage of the deformability of the material of the body of device 10, by pressing both adjoining modules one against the other so that rib 18 penetrates into groove 16.

One or more embodiments may envisage that the casing portion 14 corresponding to rib 18 includes a material which is at least slightly more rigid than the material used to form the portion hosting groove 16, thus simplifying the penetration of rib 18 into groove 16 thanks to the deformation of the materials.

It will be appreciated that a coupling as exemplified in FIG. 3 enables locating the light radiation emission surfaces 12 of two or more adjoining modules 10 in a condition of (close) contiguity, practically avoiding the formation of dark areas between light radiation emission surfaces 12 of adjoining modules, due, for instance, to the presence of the sides of casings 14, which may include light-impermeable material.

As shown in FIGS. 4 and 5, a substantially similar result may be achieved also in modules 10 having the "symmetric" design already discussed with reference to FIG. 1.

In this case, the connection between adjoining modules 10 may be achieved by means of a wire-like (optionally flexible) fixing element 180, having a "double-puzzle" or eight-shaped profile.

In one or more embodiments, said profile may be considered as deriving from an ideal (back-to-back) juxtaposition of two lobes or ribs, such as rib 18 already exemplified with reference to FIG. 2, i.e. a rib having a narrow stem portion and an enlarged head portion which reproduce, in a complementary way, the tapered portion of groove 16.

As exemplified in FIG. 5, a plurality of modules 10 having the symmetric design exemplified in FIG. 1 (i.e. with two grooves 16 located on opposed sides) may be connected with each other by interposing a fixing element 180 between each pair of adjoining modules 10. The two lobes of said fixing element 180 are adapted to respectively engage each of the two (mutually facing) grooves 16 of the two adjoining modules 10, bringing about the connection thereof as exemplified in FIG. 5, i.e. according to a solution substantially similar to what has been already exemplified with reference to FIG. 3.

Also in this case, the connection may be brought about either by lengthwise sliding the coupling element(s) 180 which have been previously inserted into grooves 16, or by pressing two modules 10 one against the other with the interposition of an element 180, so that the two lobes of elements 180 penetrate into the mutually facing grooves 16.

Embodiments as exemplified in FIGS. 4 and 5 may implement the coupling element 180 with a material at least slightly more rigid than the material of casing 14 of modules 10, so as to simplify the pressing penetration of the lobes of coupling element 180 into the mutually connected grooves 16.

Figure 7:
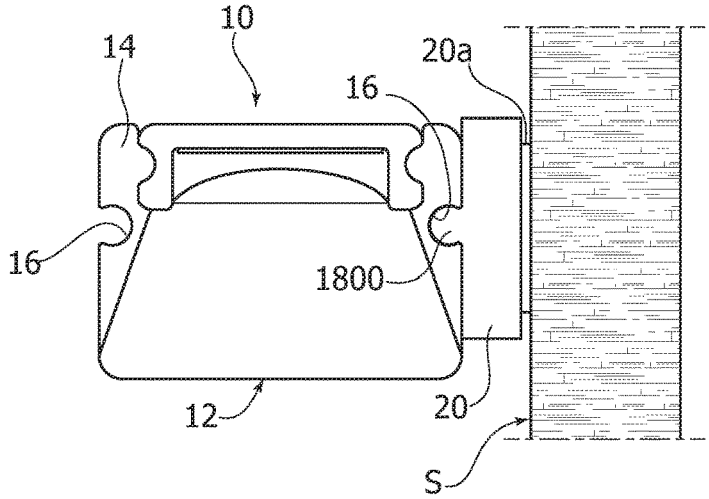
Figure 8:
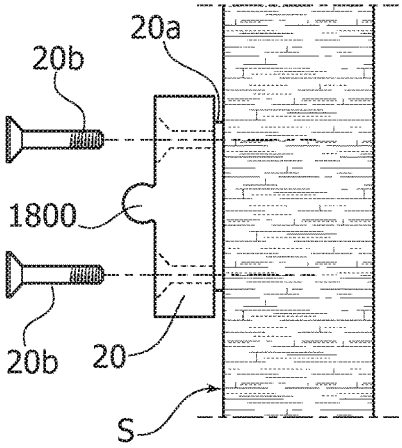

FIGS. 6 to 8 exemplify possible usages of groove 16, in order to enable mounting a module 10 onto a support structure such as a wall or mounting surface S.

In one or more embodiments, the use may be envisaged of a support 20, including e.g. an elongated element adapted to be applied onto surface S.

Said support 20 may be applied onto surface S adhesively (e.g. by means of an adhesive tape 20*a* as shown in FIG. 6) e/o by means of a mechanical fixation (e.g. via screws 20*b*, as shown in FIG. 8).

In one or more embodiments, fixing element 20 may be provided with a rib 1800 adapted to have a complementary profile to groove 16, i.e. a section profile having a restricted stem portion and an enlarged head portion, substantially similar to the profile of rib 18 in FIG. 2, i.e. to the profile of the two lobes of fixing element 180 shown in FIGS. 4 and 5.

In one or more embodiments, the groove or (as can be seen in FIG. 7) one of the grooves 16 of device 10 may be coupled with rib 1800 of support element 20, making it possible to implement (see e.g. FIG. 7) the mounting of device 10 onto support surface S.

This may take place, for example, with the light radiation emission surface 12 oriented downwards—as exemplified in FIG. 7—or upwards, as can be achieved by turning device 10 by 180° from the position shown in FIG. 7.

Figure 9:
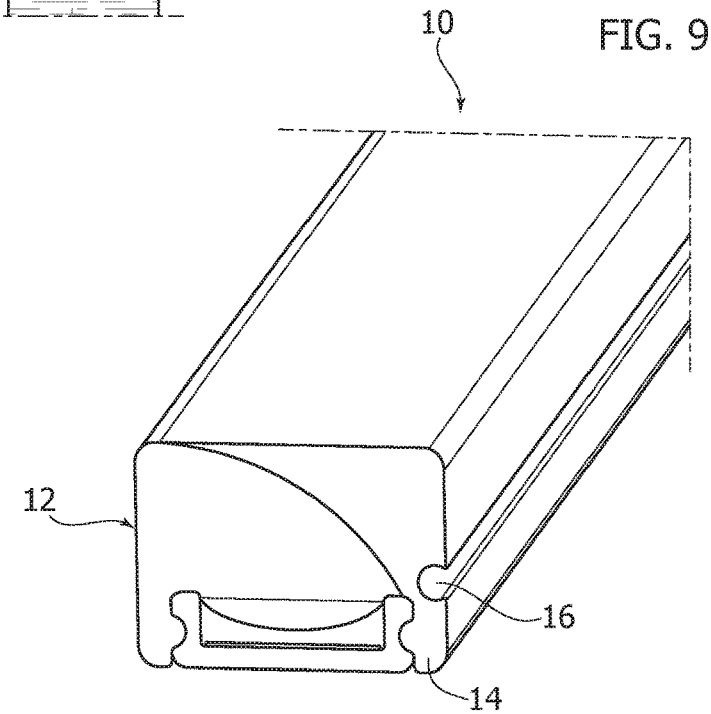

FIG. 9 highlights that, in one or more embodiments, groove(s) 16 may be located diametrically opposed to light radiation emission surface 12.

This may be the case, for example, in embodiments wherein (according to criteria described in various Patent Documents in the name of the same Applicants), the light radiation emission surface 12 extends laterally of the channel-shaped profile of casing 14 of device 10.

If applied to a device 10 of the type exemplified in FIG. 9, a fixing solution as exemplified in FIG. 7 allows the light radiation emitted from surface 12 to be directed horizontally (or, generally speaking, orthogonally to mounting surface S), while solutions as exemplified in FIG. 7 lead to a light radiation emission in a direction substantially corresponding to the extending direction of surface S.

Whatever the specific mounting solutions adopted, one or more embodiments as exemplified in FIGS. 6 to 9 may simplify the mounting operations of (protected) modules 10 onto walls, pieces of furniture, panels of various kinds.

Moreover, the optional removal of module 10 is simplified, because the latter may be slid lengthwise with respect to support element 20, or it can be removed by taking advantage of the deformability of the coupled portions (e.g. groove 16 and rib 1800) without risking a mechanical damage, so that module 10 may be re-used and/or re-positioned, e.g. when it is desired to change the application or usage thereof.

The fixing element 20 may be configured in different ways, e.g. by using either rigid materials (e.g. metal materials such as aluminium) or flexible materials, the possibility being given of obtaining a high level of flexibility in the implementation of the lighting arrangement.

As mentioned in the foregoing, the fixing of support element 20 onto surface S may take place by means of an adhesive (e.g. by means of a pre-positioned adhesive tape) or e.g. by means of screws 20*b*, without the need of providing dedicated holes to the purpose.

Figure 10:
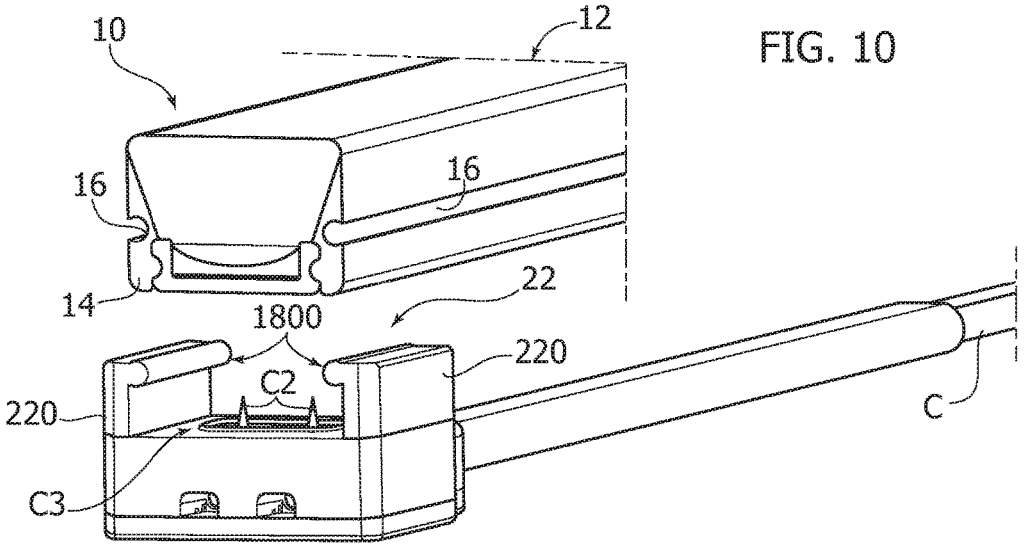

FIG. 10 and following exemplify various further usages of devices 10 according to one or more embodiments.

Figure 11:
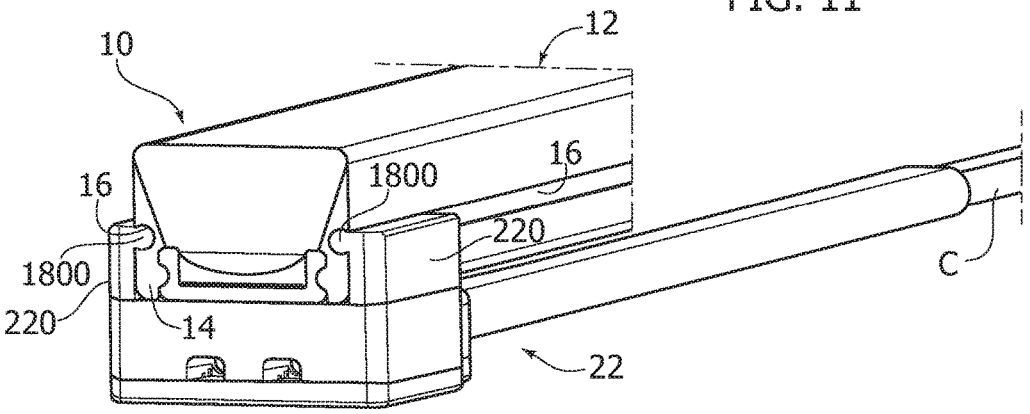
Figure 12:
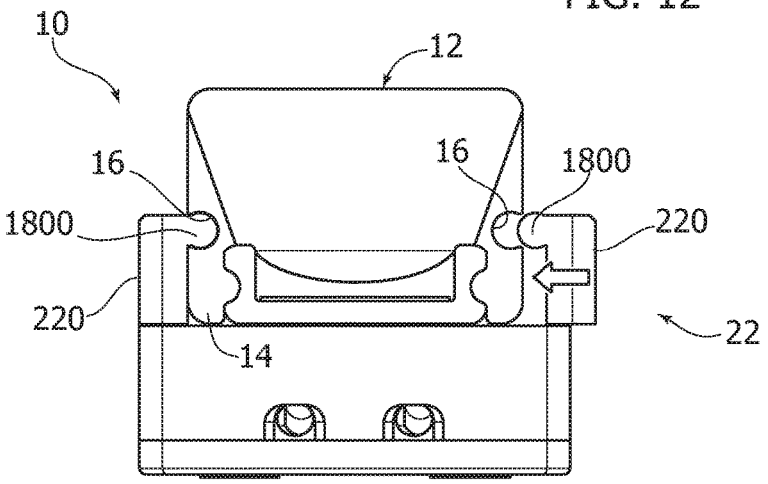

For example, FIGS. 10 to 12 exemplify the possibility of coupling module 10 with a support device 22 having the shape of a clamp, including e.g. two clamping arms or branches (denoted as 220) which are provided (e.g. at their distal ends) with ribs 1800 which may be similar to ribs 18, 180 and 1800, which have already been described in the foregoing, i.e. adapted to penetrate into grooves 16 and to be retained therein.

FIG. 12 highlights the possibility of shaping clamping element 22 so that at least one of the branches 220 may be moved from a flared or open position, which enables device 10 to be inserted into clamp 22, and a closed or clamping position (see the arrow on the right of FIG. 12), wherein rib 1800 penetrates into and is retained in groove 16 facing the same.

Also in this case, the penetration of rib 1800 into groove 16, which retains it therein, may be eased by the deformability of the material of the body of device 10 hosting groove 16.

In one or more embodiments, as exemplified in FIGS. 10 and 12, clamp 22 may be included in an electrical connector having a cable C, the connector including electrical contacts C2 (e.g. piercing contacts) adapted to penetrate into the body of device 10, so as to establish (according to known criteria)

the electrical contact with the electrically conductive lines provided in device 10 itself, e.g. for supplying the light radiation sources mounted therein.

Solutions as exemplified in FIGS. 10 to 12 enable the achievement of a firm coupling of device 10 and clamp 22, while avoiding the accidental separation (e.g. involving the loss of the electrical contact between cable C and the light radiation sources of device 10). Moreover, significant mechanical deformations/stresses on module 10 may be avoided, thus excluding the impairment of the protection grade (e.g. IP grade).

In one or more embodiments, the achievement of such a protection grade may be favoured by the presence of sealing means such as e.g. an adhesive tape, which may be arranged on the lower portion of module 10, and/or a gasket C3 provided around contact elements C2.

Figure 13:
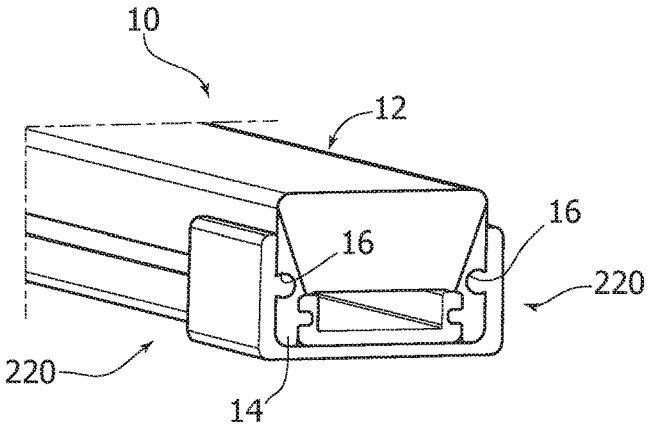
Figure 14:
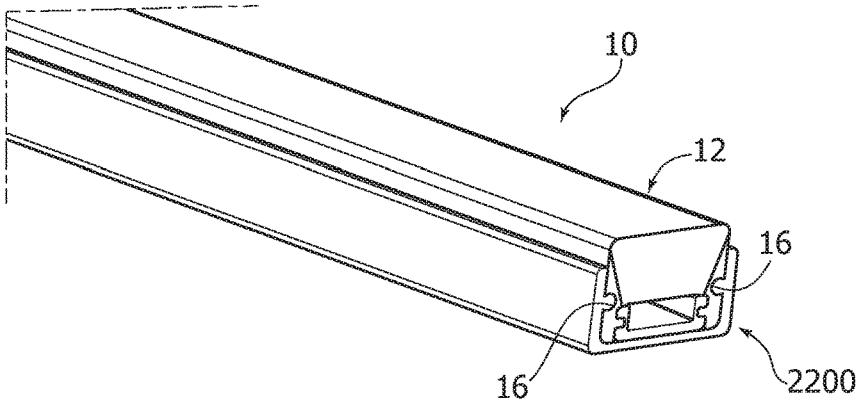
Figure 15:
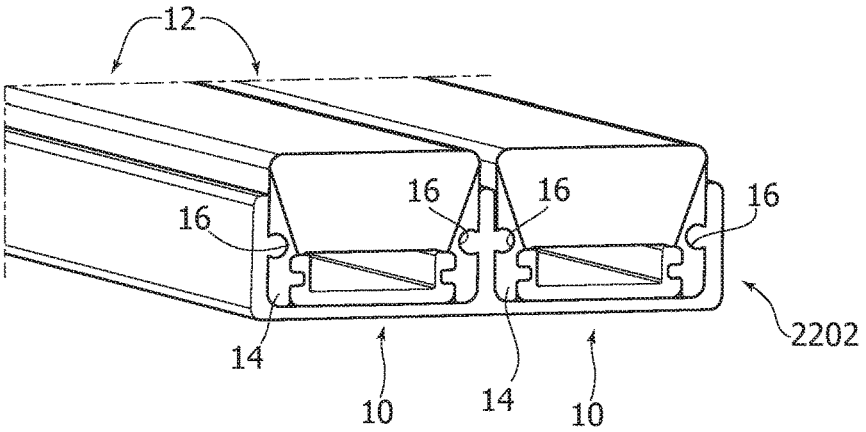

FIGS. 13 to 15 exemplify moreover that solutions according to one or more embodiments may be compatible with traditional mounting solutions, based e.g. on the use of springs or U-shaped clips 222, or with channel-shaped profiled elements 2200 (e.g. made of plastic or metal), optionally multiple elements as exemplified in FIG. 15.

One or more embodiments may therefore concern a lighting device (e.g. 10), including an elongated body (e.g. 14) having at least one light emission surface (e.g. 12), the body being adapted to have at least one longitudinal groove (e.g. 16) extending along the elongated body, said groove having a tapered cross-section with a restricted mouth portion (e.g. 161, 162) for receiving and retaining in the groove a complementary coupling element (e.g. 18, 180, 1800).

In one or more embodiments, said tapered cross-section (see e.g. FIG. 1) may extend along a substantially circular path, with said restricted mouth portion (see e.g. 161, 162 in FIG. 1) arranged at a chord position of said circular path.

In one or more embodiments, said at least one longitudinal groove may extend laterally with respect to said at least one light emission surface.

In one or more embodiments (see e.g. FIG. 1), said at least one longitudinal groove may extend in a diametrically opposite position with respect to said at least one light emission surface.

One or more embodiments may include a pair of said longitudinal grooves extending, optionally at specularly symmetrical positions, along said elongated body.

One or more embodiments may include at least one longitudinal rib (e.g. 18) extending along said elongated body, said longitudinal rib having a restricted stem portion and an enlarged head portion, and being insertable into at least one said longitudinal groove of a homologous lighting device.

In one or more embodiments, wherein said elongated body may include a casing (e.g. 14) of at least partly light-impermeable material and said at least one longitudinal groove may be formed in said casing, whereby the groove may be non-interfering with emission of light radiation from the device.

In one or more embodiments, a fixing system for a lighting device according to one or more embodiments may include at least one fixing element (e.g. 10, 20, 22) with at least one elongated rib (e.g. 18; 180; 1800) having a restricted stem portion and an enlarged head portion, said at least one rib being insertable into said at least one longitudinal groove of said lighting device.

In one or more embodiments, said fixing element may include a wire-like body (e.g. 180) including a pair of mutually opposed said elongated ribs, insertable into respective longitudinal grooves provided in a pair of lighting devices according to one or more embodiments.

In one or more embodiments, said fixing element may include a base element (e.g. 20) attachable (e.g. 20*a*, 20*b*) to a mounting surface and carrying said at least one elongated rib (e.g. 180).

In one or more embodiments, said fixing element may include a clamp (e.g. 22) having at least one clamp arm (e.g. 220) carrying said at least one elongated rib (e.g. 1800).

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A fixing system for one or more lighting devices comprising, a first lighting device comprising an elongated flexible body having at least one light emission surface, the flexible body having at least one longitudinal groove extending along the elongated flexible body, wherein the elongated flexible body comprises a casing of at least partly light-impermeable material and coupling of a portion of the first lighting device corresponding to the light emission surface to the casing protects the first lighting device against penetration of external agents, said groove formed in the casing and where the groove has a tapered cross-section with a restricted mouth portion for receiving and retaining in the groove a complementary coupling element, and wherein the groove does not interfere with emission of light radiation from the first lighting device; and at least one fixing element with at least one elongated rib having a restricted stem portion and an enlarged head portion, said at least one rib insertable into said at least one longitudinal groove of the first lighting device;

wherein a material of the at least one elongated rib is more rigid than a material of the elongated flexible body.

2. The fixing system of claim 1, wherein said fixing element includes a wire-like flexible body with a pair of mutually opposed said elongated ribs insertable into respective longitudinal grooves provided in a pair of lighting devices, the lighting device comprising a pair of said longitudinal grooves extending along said elongated flexible body.

3. The fixing system of claim 1, wherein said fixing element includes a base element attachable to a mounting surface and carrying said at least one elongated rib.

4. The fixing system of claim 1, wherein said fixing element includes a clamp having at least one clamp arm carrying said at least one elongated rib.

5. The fixing system of claim 1, wherein the side of the elongated body having the at least one longitudinal groove extending therealong is substantially planar to minimize rotational movement when the first lighting device is coupled to a second lighting device.

6. The fixing system of claim 5, wherein a second side parallel to the side of the elongated body having the at least one longitudinal groove is also substantially planar to minimize rotational movement when the first lighting device is coupled to a third lighting device.

7. The fixing system of claim 5, further comprising the second lighting device coupled to the first lighting device via the at least one rib insertable into the at least one longitudinal groove of the first lighting device; and wherein a side of the second lighting device substantially abuts against a side of the first lighting device over their entire area of both the side of the second lighting device and the side of the first lighting device.

8. The fixing system of claim 1, wherein said tapered cross-section extends along a substantially circular path with said restricted mouth portion arranged at a chord of said circular path.

9. The fixing system of claim 1, wherein said at least one longitudinal groove extends laterally with respect to said at least one light emission surface.

10. The fixing system of claim 1, wherein said at least one longitudinal groove extends in a diametrically opposite position with respect to said at least one light emission surface.

11. The fixing system of claim 1, further comprising a pair of said longitudinal grooves extending along said elongated body.

12. The fixing system of claim 1, further comprising at least one longitudinal rib extending along said elongated body, said longitudinal rib having a restricted stem portion and an enlarged head portion for insertion into said at least one longitudinal groove of a homologous lighting device.

13. The fixing system of claim 1, wherein said elongated body includes a casing of at least partly light-impermeable material and wherein said at least one longitudinal groove is formed in said casing.

* * * * *